US005161959A

United States Patent [19]

Gettel

[11] Patent Number: 5,161,959

[45] Date of Patent: Nov. 10, 1992

[54] VISCOSITY SENSITIVE HYDRAULIC PUMP FLOW CONTROL

[75] Inventor: Roger W. Gettel, Bloomfield Hills, Mich.

[73] Assignee: Ford Motor Company, Dearborn, Mich.

[21] Appl. No.: 667,130

[22] Filed: Mar. 11, 1991

[51] Int. Cl.[5] ..... F04B 49/00

[52] U.S. Cl. ..... 417/300; 417/310

[58] Field of Search ..... 417/300, 302, 307, 310; 165/177; 138/31

[56] References Cited

U.S. PATENT DOCUMENTS 4,289,454 9/1981 Iwata .
4,470,762 9/1984 Wendler .
4,470,764 9/1984 Anderson et al. .
4,470,765 9/1984 Hegler .
4,473,128 9/1984 Nakayama et al. .
4,485,883 12/1984 Duffy .
4,561,521 12/1985 Duffy .
4,570,735 2/1986 Duffy .
4,609,331 9/1986 Duffy .
4,691,619 9/1987 Kervagoret .
4,714,413 12/1987 Duffy .
4,776,177 10/1988 Jancic et al. ..... 165/177
4,881,596 11/1989 Bergmann et al. ..... 165/177
4,887,632 12/1989 Tanaka et al. ..... 417/300

*Primary Examiner*—Richard A. Bertsch
*Assistant Examiner*—Alfred Basichas
*Attorney, Agent, or Firm*—Frank G. McKenzie; Roger L. May; Raymond L. Coppiellie

[57] ABSTRACT

The flow control system includes a flow control valve, an orifice located between the pump outlet port, a passage carrying feedback pressure at a location downstream from the orifice to one side of the valve, and a bypass port located between the pump outlet and the pump inlet. The bypass port opens as a valve spool moves due to differential pressure across the orifice. When pump discharge is low, the valve closes the bypass port; when pump flow rate increases, the valve opens the bypass port. The jet pump effect of a bypass diffuser, located between the bypass port and the pump inlet, supercharges low pressure fluid in a remote reservoir by using kinetic energy in the bypass flow to draw fluid from the reservoir into the pump and to raise static pressure at the pump inlet. A clip having a relatively large wetted surface area in comparison to its cross sectional area is located in a passage connecting the pump outlet and the load.

13 Claims, 7 Drawing Sheets

VISCOSITY SENSITIVE HYDRAULIC PUMP FLOW CONTROL

BACKGROUND OF THE INVENTION

1. Field of the Invention

This invention relates to fluid flow rate controls for hydraulic pumps, especially for automotive power steering pumps. The invention pertains to a device for enhancing the sensitivity of such a control to conditions of high viscosity so that an effect of cold start pump cavitation is eliminated.

2. Description of the Prior Art

At temperature near −40° F., viscosity or resistance to flow, of fluid used in automotive power steering systems increases by about 8000 times its viscosity at 275° F. At low temperature, the fluid flows like thick, heavy syrup at room temperature.

Conventionally, power steering systems have a reservoir located remotely from the hydraulic pump that pressurizes the system. The remote reservoir allows its placement in a relatively uncongested region in comparison to the region surrounding the pump and drive belt sheave, by which the pump is driven from an engine. A pressure drop of 5–7 psi occurs at low temperature in a tube connecting the remote reservoir to the pump inlet. Another pressure drop of about the same magnitude is present within the pump between its inlet and the pumping chamber. These pressure drops cause an extremely low pressure, about 1 psi., in the pump chamber at low temperature.

When the engine is started in cold weather, pump speed immediately rises, but viscosity is too high to permit sufficient fluid from the remote reservoir to enter and to fill the pumping chamber. This cavitates the pump and causes an offensive high frequency scream lasting several seconds as fluid pressure in the steering gear supplied from the pump cycles rapidly between zero pressure to 100 psi. The cyclic nature of the pressure variation is a consequence of successive short periods of slug-like flow through the pump, when a pumping chamber is at least partially filled with fluid, followed by a short period when the pumping chambers are substantially fully vacant.

The characteristic noise is objectionable and evidences a brief period during which the system or load is only partially pressurized. As flow rate increases, fluid temperature rises rapidly to a temperature where cavitation ceases, system becomes fully pressurized, noise disappears, and function is normal.

To overcome the cold start difficulties, it is conventional practice to increase the size of hoses connecting the pump to the steering gear and the reservoir to the pump inlet in order to enhance flow. Hydraulic fluid, whose viscosity increases only about 4000 times between 275° F. and −40° F. is used at a substantial increase in cost over fluid having the usual viscosity increase over this temperature range.

Various techniques for controlling operation of the flow control valve have been developed. For example, U.S. Pat. No. 4,289,454 describes a vane pump having two outlet ports, one port being closed after the flow rate exceeds a predetermined magnitude due to an increase in speed of the rotor. The excess fluid normally passing through one of the outlet ports is returned to the pump inlet to increase the fluid flow rate to the steering gear during high speed conditions.

U.S. Pat. No. 4,470,762 describes a pump having a control that bypasses flow from the pump between a cam ring and thrust plate. A spring opens the bypass passage and a pressure plate closes the bypass passage when system pressure rises. The pump control described in U.S. Pat. No. 4,470,764 includes a spring operating on a valve spool to open bypass flow and biased by system pressure to reduce bypass flow. In the vane pump of U.S. Pat. No. 4,470,765, output flow is partially bypassed through a flow control valve. The valve is operated by system pressure to close bypass passages as system pressure rises, thereby increasing flow to the power steering system.

More recently, power steering systems include electronically variable orifices that are opened and closed in response to vehicle speed and steering wheel speed so that the flow rate to the steering gear from the pump outlet is high when the required steering assist is high, particularly at low vehicle speed, and is low when the required steering assist is low, particularly at high vehicle speed and low steering wheel speed. An example of a power steering system controlled in this way is described in U.S. Pat. No. 4,473,128 in which a bypass valve directs a portion of the fluid flow from the pump from the steering gear in response to vehicle speed and angular velocity of the steering wheel. The position of the bypass valve is controlled by a solenoid, energized and deenergized on the basis of control algorithms executed by a microprocessor. The flow control valve described in U.S. Pat. No. 4,691,619 is also operated by a solenoid, which is energized and deenergized in response to vehicle speed. A pressure modulated slide valve is hydraulically piloted by a solenoid-operated valve. Fluid flow to the steering gear is controlled entirely hydraulically in response to vehicle speed and demand requirements represented by the steering gear input.

U.S. Pat. No. 4,485,883 describes a power steering system having a bypass valve controlling the flow rate of fluid directed from the pump outlet to the pump inlet and a constant flow valve for regulating the flow of bypass fluid. This control system reduced the flow rate to the steering gear during steering maneuvers at high speed and increases the flow rate at low speed and during parking maneuvers.

A similar object is realized with the power steering systems described in U.S. Pat. Nos. 4,561,561; 4,570,735. A vehicle speed sensitive valve operates to deactivate a conventional flow control bypass valve by eliminating differential force on the flow control valve at speeds greater than a predetermined value. U.S. Pat. No. 4,714,413 describes a power steering system of this type. Another control system of this type employing a solenoid-operated vehicle speed sensitive valve in combination with a conventional flow control bypass valve is described in U.S. Pat. No. 4,609,331.

SUMMARY OF THIS INVENTION

The flow control system of the present invention includes a flow control valve, an orifice located between the pump outlet port, a passage carrying feedback pressure at a location downstream from the orifice to one side of the valve, and a bypass port located between the pump outlet and the pump inlet. The bypass port opens as a valve spool moves due to differential pressure across the orifice. When pump discharge is low, the valve closes the bypass port; when pump flow rate increases, the valve opens the bypass port. The jet pump effect of a bypass diffuser, located between the bypass port and the pump inlet, supercharges low pressure fluid in a remote reservoir by using kinetic energy in the bypass flow to draw fluid from the reservoir into the pump and to raise static pressure at the pump inlet.

The pressure drop across the orifice is increased by inserting in a passage located between the orifice and the pressure feedback line a device having a large surface area, particularly a large wetted surface area and a relatively small cross sectional area. The device may be in the form of a wire or sheet metal clip, approximately 0.3 inches long, having in cross section several loops or arcs disposed in the passage and having outer surfaces adapted for interference fit with the surface of the passage, by which interference the clip is held in position against the effect of fluid flowing in the passage. The loops increase the surface area wetted by the fluid in the passage without appreciably increasing its cross sectional area.

An alternate technique involves having multiple small passages located between the pump outlet and the pressure feedback line instead of one larger passage. The wetted surface area of the small passages is substantially greater than that of the larger passage, yet the pressure drop across the smaller passages can be kept the same as that of the larger passage.

Another option is to increase the length of the passage that connects the orifice and the feedback pressure line. This effectively increases the wetted surface area of the passage without changing its cross sectional area.

These devices and techniques cause a larger pressure drop between the outlet of the pump and the feedback pressure line at low temperature, or while fluid viscosity is high, than they do at higher temperature because high viscosity causes the pressure drop to increase substantially due to large surface area drag. At relatively low viscosity, the effect of surface area is substantially less than when viscosity is high. The net cross sectional area of the passage and a restriction device such as a clip located in the passage, increases the pressure drop along the passage at both high viscosity and low viscosity. Therefore, the flow restriction device or the form of the passage is such that the increase in wetted surface area is large compared to the reduction in cross sectional area.

The effect of the passage restrictions of this invention is to reduce, for a given pump discharge flow rate, the magnitude of the feedback pressure force developed on the valve spool, or to increase the pressure drop between the pump and the valve spool. Therefore, the valve opens the bypass port more fully at low temperature than it does at higher temperature, thereby reducing the pressure drop in the tube connecting the remote reservoir and the pump inlet. Furthermore, at low temperature, the supercharging effect of the bypass diffuser, in drawing fluid from the reservoir and increasing pressures at the pump inlet, is enhanced.

DESCRIPTION OF THE PREFERRED EMBODIMENT

Figure 1:
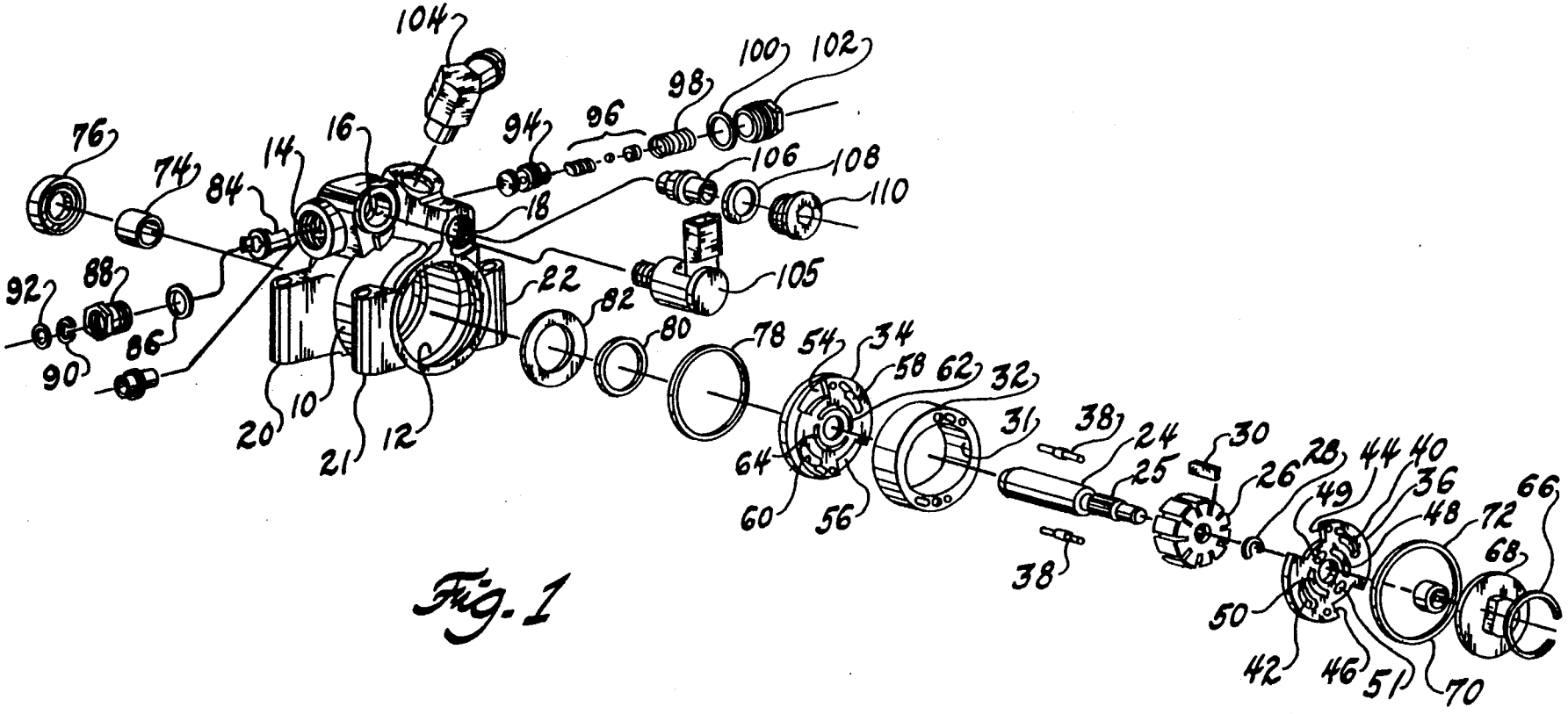
FIG. 1 is an isometric view of a power steering pump, showing its pumping components and control elements spaced axially from adjacent components.

A rotary vane hydraulic power steering pump according to this invention supplies pressurized fluid to an automotive vehicle steering gear. The pump includes a housing 10 defining a cylindrical space containing the pumping elements, a bore 14 containing a flow control valve and related components, a bore 16 communicating with bore 14 and containing an electronically variable orifice, and a diffuser passage 18. The housing includes at least three bosses 20–22, each having a cylindrical hole adapted to receive a mechanical attachment such as a bolt, which can be threaded directly to the engine block of the vehicle. In this way, the conventional bracket usually used to support a power steering pump located in position to be driven by a V-belt from the engine crankshaft can be eliminated.

The components that pump hydraulic fluid from a reservoir to the steering gear are rotatably supported on a shaft 24, driven by an endless drive belt from an engine and rotatably connected by a splined connection to a rotor 26 fixed in position on the shaft by a snap ring 28. The rotor has ten radially sliding vanes, held in contact with the inner surface of a cam ring 32 having two arcuate zones extending angularly in rise or inlet quadrants and two zones of lesser radial size extending angularly in fall or outlet quadrants mutually separated by the inlet quadrants. A lower pressure plate 34 and an upper pressure plate 36 are fixed in position radially with respect to the cam 32 by alignment pins 38. Formed through the thickness of the upper pressure plate are arcuate outlet ports 40, 42 communicating with an outlet port opening to the flow control valve bore 14, inlet ports 44, 46 and arcuate passages 48, 50 for use in cold starting priming. The lower pressure plate has inlet ports 56, 54 formed through its thickness, outlet ports 58, 60 and arcuate flow passages 62, 64 hydraulically connected to passages 48, 50.

A wire retaining ring 66 seats within a recess at the end of the pump housing to hold in position a pump cover 68. Bushing 70 supports shaft 24 on a recess in the inner surface of the cover. Seal 72 prevents the passage of hydraulic fluid.

The opposite end of the rotor shaft is supported rotatably in a bushing 74, which is supported on the housing; a shaft seal 76 prevents flow of hydraulic fluid from the pumping chambers. Located adjacent the lower pressure plate on the opposite side from the cam are an inner seal 78, an outer seal 80, and a Belleville spring 82, which develops an axial force tending to force mutually adjacent surfaces of the various components into abutting contact.

Located within bore 14 are a discharge port orifice 84, seal 86, connector 88, a retaining ring 90, and O-ring seal 92. Also located within bore 14 is a relief valve spool 94, a coiled compression spring, ball, ball seat 96 and a larger compression spring 98 urging spool 94 toward a high speed position where the flow control valve is open. A Teflon seal 100 and plug 102 close the adjacent end of the bore mechanically and hydraulically. A tube assembly 104 connects a tube carrying fluid from the steering gear to the pump housing, through which it passes in suitable ports to the pumping chamber. An actuator assembly 105 for an electronically variable orifice is engaged by screw threads in bore 16.

A system for supercharging fluid at the pump inlet includes a diffuser 106, seal 108 and plug 110 engaged with screw threads formed in bore 18 of the housing.

Figure 2:
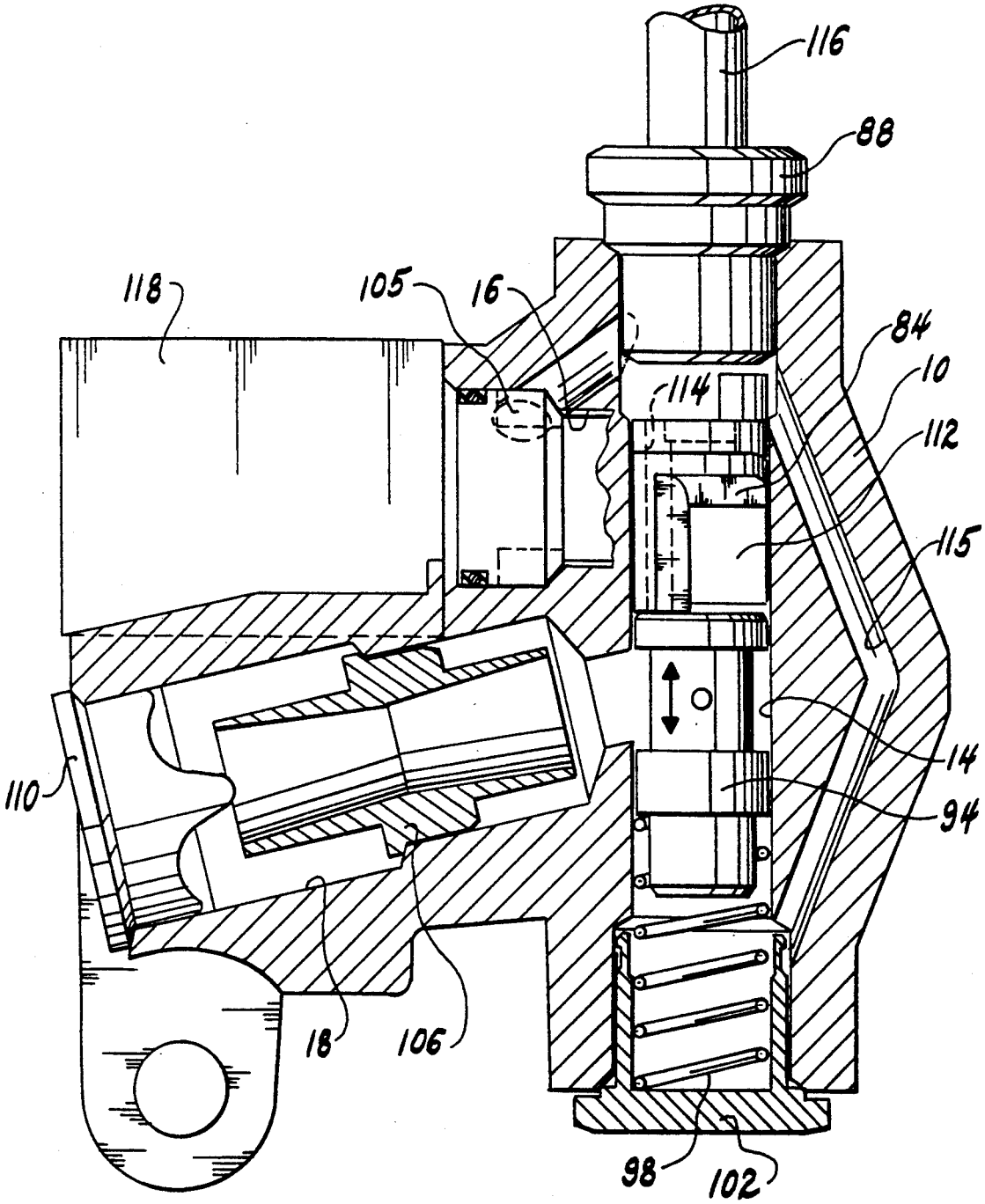
FIG. 2 is a cross section through the power steering relief valve and adjacent housing area with the components disposed in the low speed position.

Referring now to FIG. 2, the outlet ports in the pressure plates are connected through port 112 to bore 14 in which relief valve 94 is located. Orifice 84 has an axially directed passage 114, which continually connects port 112 to the pressure tube 116, which carries high pressure hydraulic fluid to the steering gear from the pump.

Figure 4:
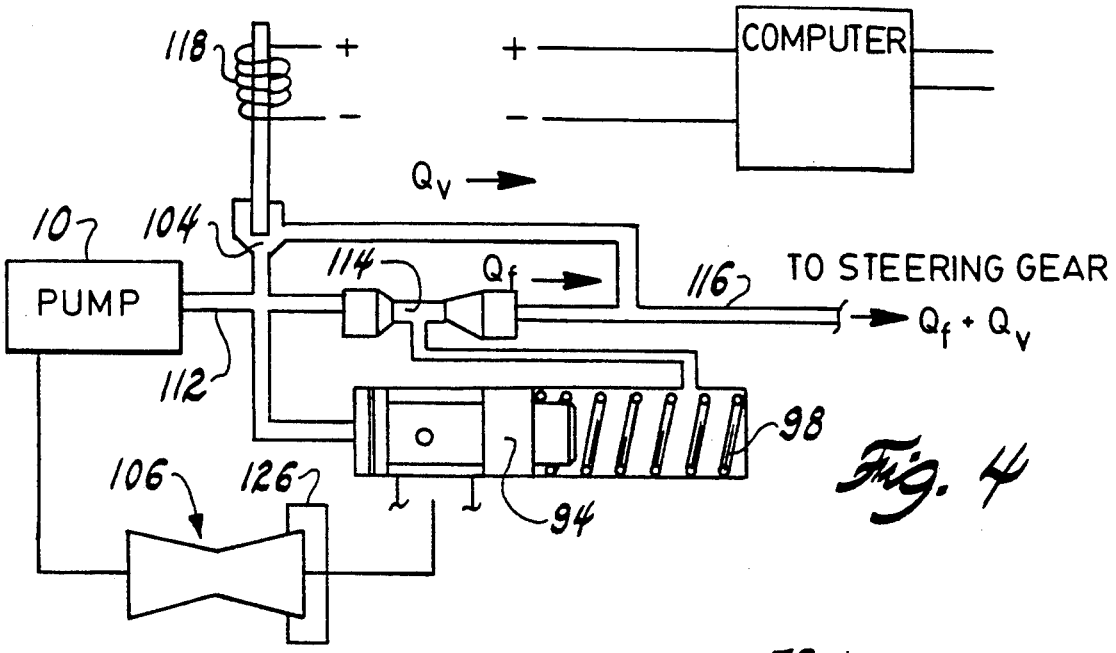
FIG. 4 is a schematic diagram showing the parallel flow arrangement of a constant area orifice and variable area orifice between the pump outlet and the steering gear.

Electronically variable orifice assembly 105 includes a solenoid 118, operated by an output signal produced by a microprocessor accessible to control algorithms and input signals produced by speed sensors, which produce signals representing the speed of the vehicle and steering wheel. As these control algorithms are executed, an electronically variable orifice 105 opens and closes communication between port 112 and pressure tube 116. In this way, the fixed orifice of passage 114 and the electronically variable orifice 105 are in parallel flow arrangement between passage 112 and the outlet to the steering gear. Therefore, the flow rate through passage 114 can be adjusted through operation of the pressure relief valve independently and without affecting the position of the electronically variable orifice. FIG. 4 illustrates the arrangement of the fixed orifice and variable orifice between the pump outlet and steering gear.

The flow rate through port 112 is proportional to the speed of the pump shaft 24 and to the speed of the engine to which that shaft is connected. An orifice aperture 114 produces a pressure drop relative to pressure at port 112. Pressure downstream of aperture 114, the steering system pressure, is fed back in passage 115 to the end of the spool contacted by spring 98. A force resulting from the feedback pressure adds to the spring force on the spool. When pump speed increases, hydraulic system pressure in port 112 increases, thereby forcing spool 94 against the effect of compression spring 98 and the feedback pressure force. This action opens passage 114 to the steering gear and adds the flow through passage 114 to the flow through the electronically variable orifice from port 112. System pressure carried in passage 115 to the end of spool 94 opposes the pressure force on the spool tending to open the valve.

Figure 3:
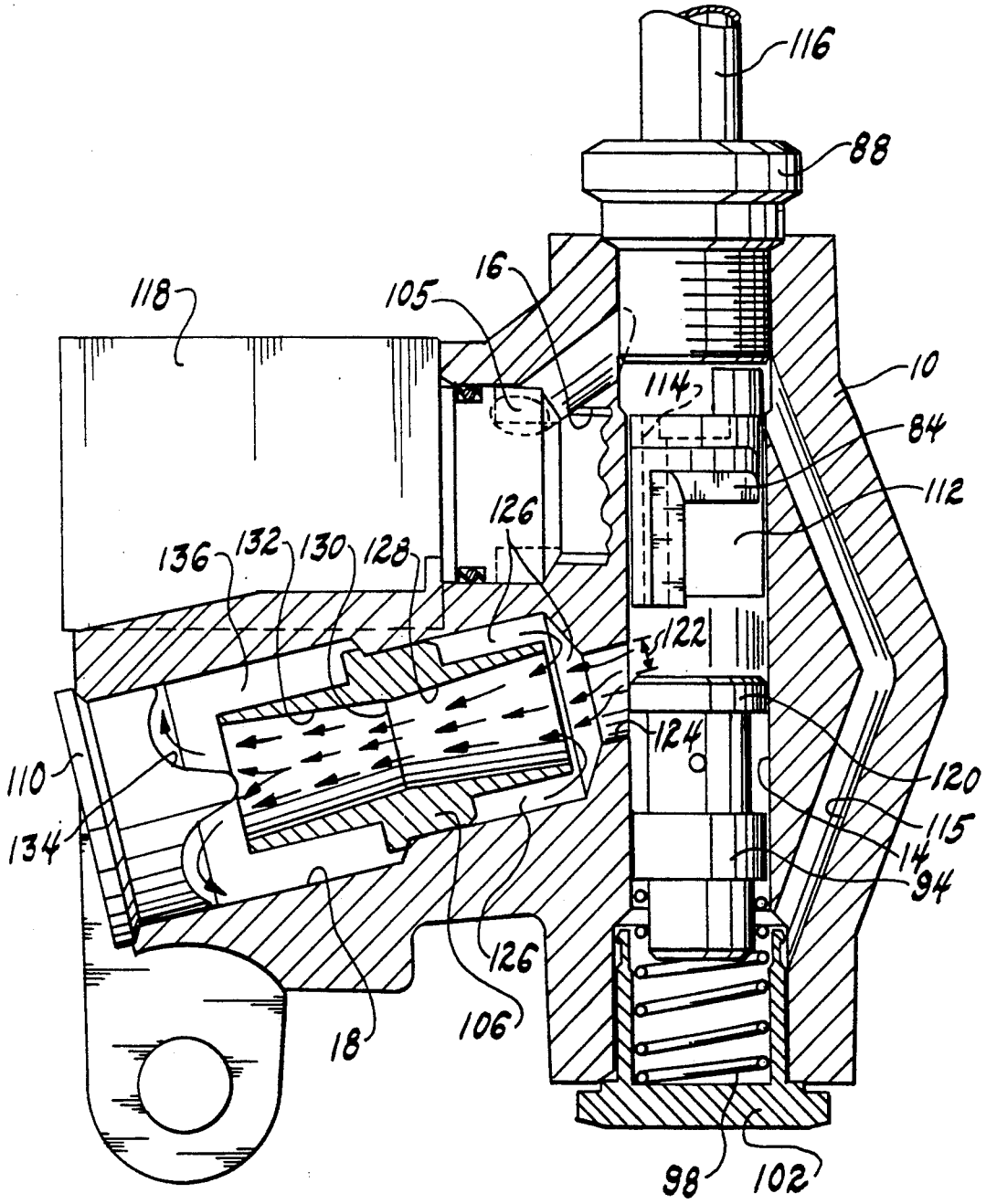
FIG. 3 is a cross section through the power steering relief valve and adjacent housing with the components disposed in the high speed position.

FIG. 3 shows spool 94 in a more fully opened position from that of FIG. 2, where land 120 opens the axial end of passage 114. When valve spool 94 moves to the high speed position of FIG. 3, bypass port 122, a passage that connects bore 114 and inlet passage 124 to the diffuser 106, opens. As relief valve 94 opens, the size of the bypass port 122 increases progressively, thereby increasing the flow rate through the diffuser. The annular space 126 between diffuser 106 and bore 18 and the cylindrical space between bypass port 122 and the diffuser entrance communicates with low pressure fluid in a reservoir or a return line, such as the line connected to fitting 104, returning fluid to the inlet ports and the pumping chambers, the space between the rotor vanes, rotor and inner surface of the cam. When bypass port 122 opens, fluid at an extremely high flow rate enters space 126 and contracting portion 128 of the diffuser. This action produces a jet pump, in which the stream of low pressure fluid from space 126 and high pressure fluid mix. The combined stream increases in velocity in the diffuser up to the diffuser throat 130 due to the reduction in cross sectional area along the length of portion 128. The combined fluid stream expands after passing the throat along the length of the expansion portion 132, the diffuser causing a reduction in velocity of the fluid, a conversion of the kinetic energy in the fluid, and an increase in static pressure. Plug 110 is formed with a contour 134 that directs fluid from the exit of the diffuser into an annular zone 136, which is connected directly to the inlet ports of the pumping chamber.

Whereas, in a conventional pump of this type, low pressure fluid in a reservoir enters the pumping chambers at low or substantially zero pressure, the jet pump effect produced by high velocity stream of excess bypass fluid from the pressure relief valve combined with low pressure fluid returning from the power steering system supercharges fluid entering the pump inlet and increases the overall efficiency of the pump. Instead of dissipating kinetic energy in the stream of high pressure fluid produced when the pump operates at high speed by returning it to a low pressure reservoir, energy in that fluid stream is used first to draw fluid from the reservoir or return line into the high velocity stream. Then the combined fluid stream velocity is increased by passing the stream through a first contracting portion of the diffuser and increasing static pressure by allowing the high velocity fluid stream to expand through the diffuser and to be carried in the high pressure-low velocity to the inlet of the pumping chamber. Test results using this supercharging technique show that when the power steering system pressure is operating at approximately 85 psi, pressure in the fluid stream between the diffuser and the inlet to the pumping chambers is approximately 40 psi.

Figure 5:
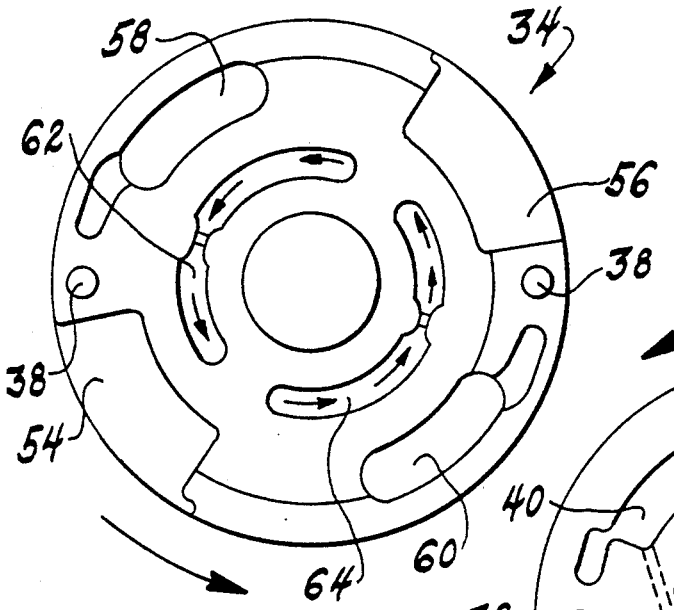
FIG. 5 is an end view of the lower plate showing the relative position of inlet and outlet ports, and passages to facilitate cold start priming.
Figure 6:
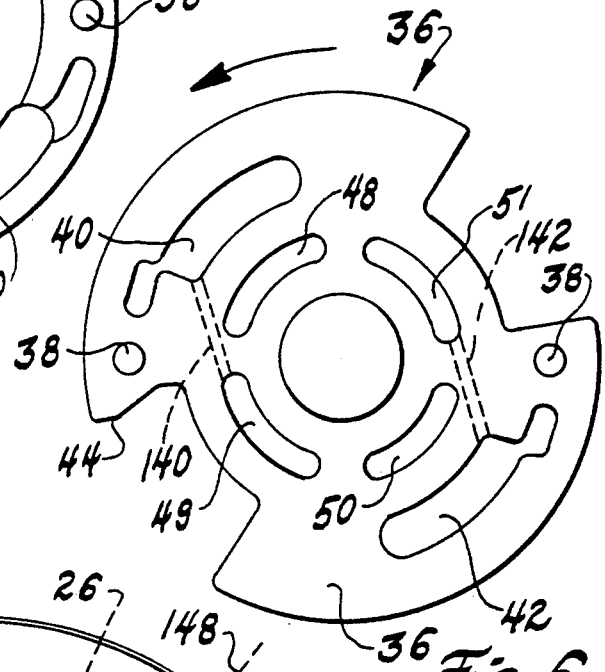
FIG. 6 is an end view of the upper pressure plate showing the relative angular and radial positions of the inlet and outlet ports and the passages communicating with those of the lower pressure plate through vane slots of the rotor.

Details of the pressure plates are shown in FIGS. 5 and 6. Lower pressure plate 34 has two diametrically opposite inlet ports 54, 56 and two diametrically opposite outlet ports 58, 60, each outlet port spaced approximately an equal angular distance from the inlet ports. Two arcuate, diametrically opposite channels 62, 64, located radially and angularly at a position to communicate with terminal holes at the radial base of the rotor slots, are formed in the face of the lower plate adjacent the rotor surface.

The upper pressure plate 36 includes inlet ports 44, 46 radially and angularly aligned with the corresponding inlet ports of the lower pressure plate, and outlet ports 40, 42 radially and angularly aligned with outlet ports 58, 60, respectively. The upper pressure plate has two pairs of passages 48, 49 and 50, 51 aligned angularly and radially with the terminal holes at the radially inner end of the rotor slots and with channels 62, 64, respectively, of the lower pressure plate. Cover 68 includes passages 140, 142, which connect passages 49 and 51 to the pump outlet ports 40 and 42, respectively.

Figure 7:
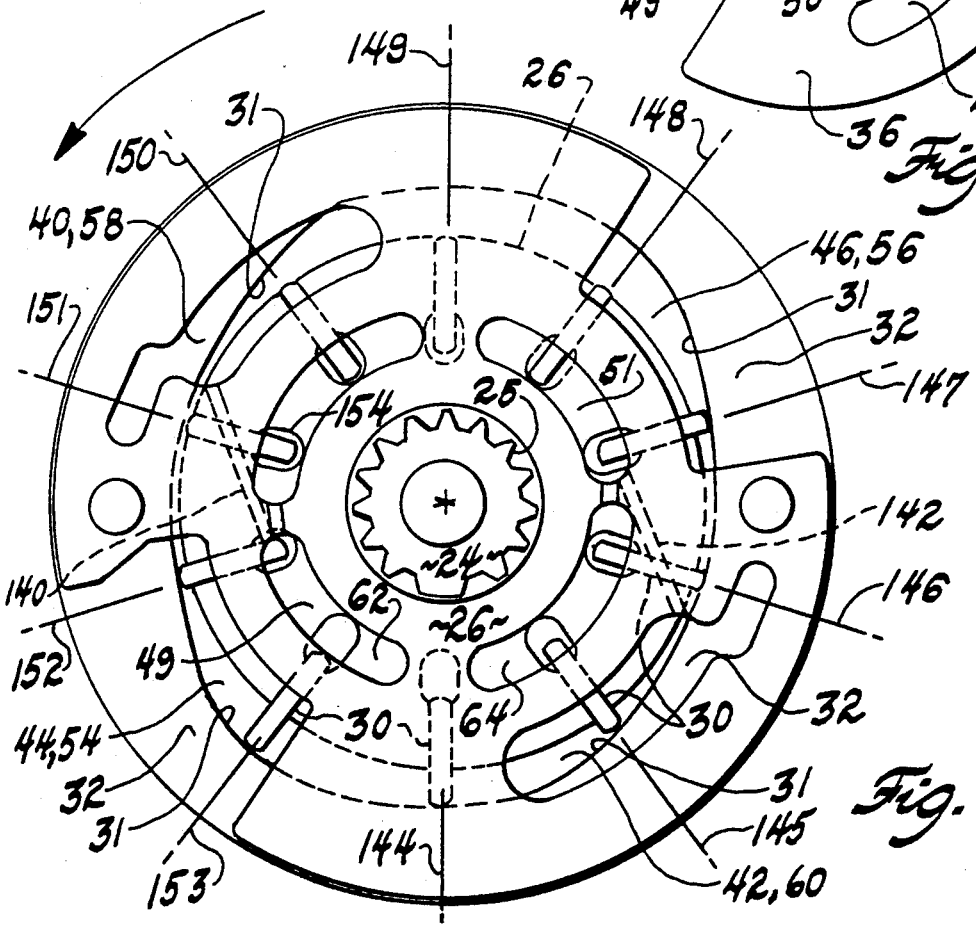
FIG. 7 is an end view superimposing the lower pressure plate, upper pressure plate, cam, rotor, vanes, and hydraulic passages connecting these.
Figure 11:
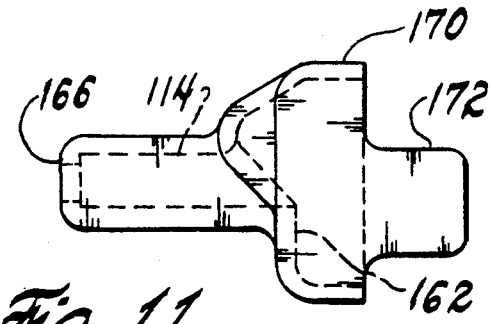
FIG. 11 is an end view of the orifice fitting.
Figure 12:
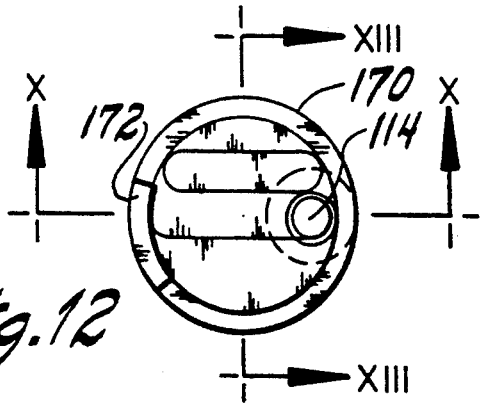
FIG. 12 is a side view of the fitting of FIG. 11.
Figure 13:
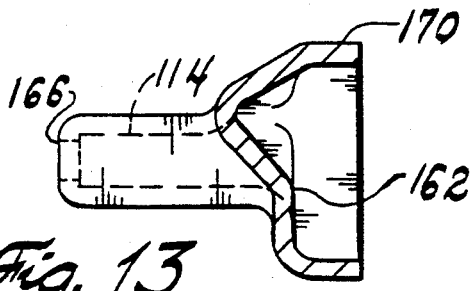
FIG. 13 is a cross section taken at plane XIII—XIII in FIG. 11.
Figure 10:
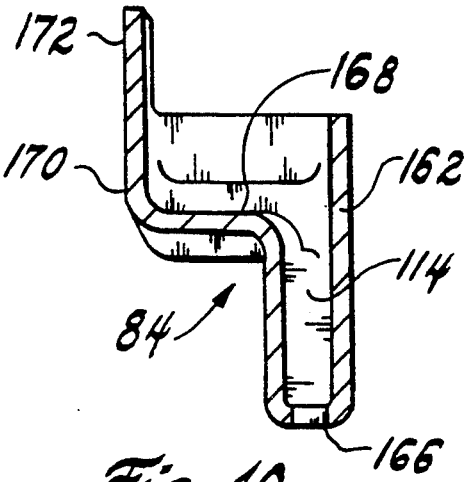
FIG. 10 is a cross section of the orifice fitting according to this invention taken at plane X—X of FIG. 11.

FIG. 7 shows ten rotor vanes 30 located within radially directed slots in each of ten locations 144–153. In normal operation, the radial tip of each vane contacts the inner surface 31 of cam 32 so that the vanes rise within the slots twice during each revolution and fall within the slots twice during each revolution. The vanes rise within inlet quadrants that include the inlet ports 44, 46, 54, 56; the vanes fall within outlet quadrants that include outlet ports 40, 42, 58, 60; the inlet quadrants being spaced mutually by an outlet quadrant. The radial end of each slot includes a terminal hole 154 extending through the axial thickness of the rotor and along a radial depth located so that each terminal hole passes over the arcuate passage 62, 64 of the lower pressure plate and the arcuate passages 48–51 of the upper pressure plate. The terminal holes, therefore, connect hydraulically the passages of the lower pressure plate that are adjacent the lower surface of the rotor 26 and the passages of the upper pressure plate that are adjacent the upper surface of the rotor.

In operation, when rotor rotation stops, the vanes located above the horizontal center line of the rotor slide along the radial length of the slot toward the terminal hole, due to the effect of gravity, and the vanes below the horizontal center line remain in contact with the inner surface of the cam ring. The fit between the vanes and their slots is a close tolerance fit. At low temperature, the viscosity of the power steering fluid is large.

When a conventional power steering pump rotor is started with the vanes in this position and at low temperature, the vanes at positions 148–150 remain at the bottom of the slot and outlet passages 40, 58 are connected to the inlet passages 46, 56 because those vanes are not in contact with the cam surface. The tightness of the fit of the vanes within the slots and the viscosity of the fluid operate in opposition to the effect of centrifugal force tending to drive the vanes radially outward. However, as the rotor rotates counterclockwise as viewed in FIG. 7, hydraulic fluid in the terminal holes above those vanes in contact with the cam is displaced as each such vane falls within the slot as those vanes enter the fall or outlet quadrants. As the vanes fall, they force fluid present within the terminal holes and rotor slots toward passages 62, 64 in the lower plate. There is no flow toward the upper plate because passages 48, 50 are blind. Within passages 62, 64 flow is in the direction of rotation, i.e., toward the rise or inlet quadrant. Because ports 48, 50 are blind, the only connection across the rotor between passages 62, 64 and outlet passages 40, 42 is through the axial length of the terminal holes in the inlet quadrant where the vanes are attempting to rise in their slots. To reach the outlet passages 40, 42, fluid pumped from the vane slots in the fall or inlet quadrant then crosses the rotor through the terminal holes at the radial end of those slots located in the inlet quadrant, i.e., from passages 62, 64 of the lower plate to passages 49, 51 of the upper plate.

Fluid pumped from the vane slots and terminal holes by the vanes in the fall quadrants of the cam applies a pressure in the terminal hole urging vanes within the rise quadrants radially outward into contact with the cam surface. When viscosity and friction forces tending to hold vanes near the bottom of the rotor slots exceed forces tending to move the vane radially outward, the pressure below the vane in each slot is a maximum on the axial side of the rotor adjacent the lower pressure plate and declines due to pressure drop along the axial length of the rotor.

Figure 8:
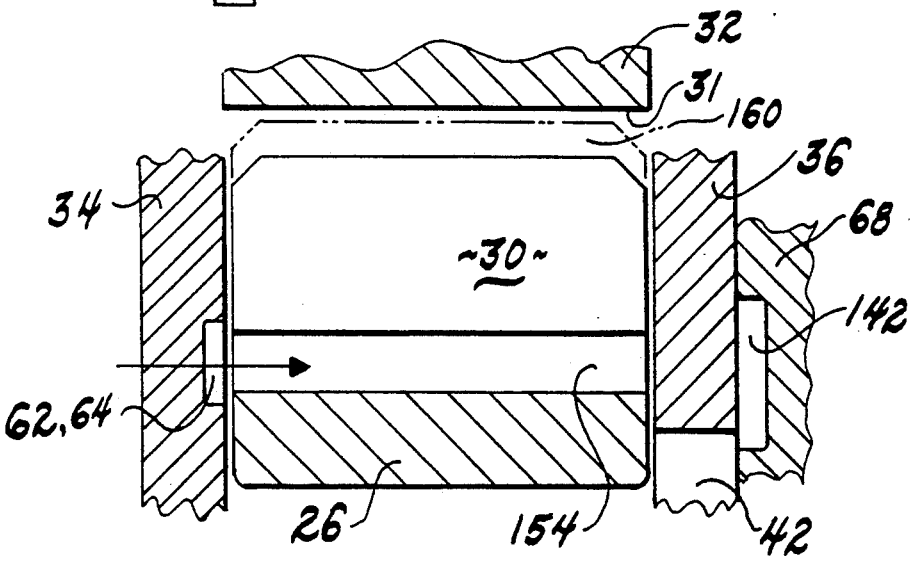
FIG. 8 is a partial cross section taken along the axis of the rotor shaft through the pressure plates rotor and cam.

An explanation of the hydraulic principles operating to cause all of the vanes of the pump to move outward into contact with the cam surface during a cold start condition is explained with reference to FIGS. 8 and 9. Fluid pumped by the vanes falling within their slots is pumped in the direction of rotor rotation across the axial length of the rotor through the terminal holes from the lower pressure plate to the blind ports of the upper pressure plate and then through passages 140, 142 in the cover to the outlet ports in the upper pressure plate. FIG. 8 shows the condition where a rotor vane is held at the bottom of the terminal hole due to friction and viscosity and has radially directed hydraulic pressure distributed along its length tending to move the vane outward in opposition to the forces holding the vane at the bottom of the terminal hole.

Figure 9:
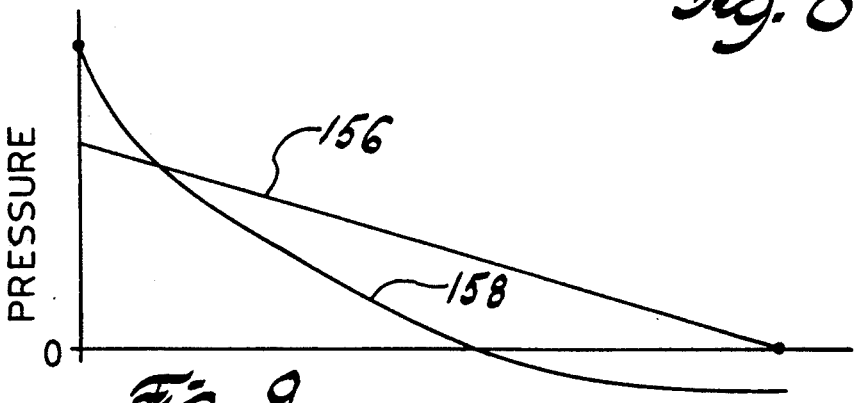
FIG. 9 is a graph representing the variation of pressure in the rotor vane slot along the axial length of the terminal hole.

Curve 156 in FIG. 9 represents the variation of pressure within the terminal hole between the upper pressure plate and the lower pressure plate. When the vane is located at the bottom of the terminal hole, a pressure drop results because of fluid friction associated with the high viscosity fluid along the axial length of the terminal hole 154. At the end of the terminal hole adjacent the upper pressure plate, the static pressure of the hydraulic fluid in the terminal hole will be substantially zero because the terminal hole at the upper pressure plate is connected by passage 142 to the outlet passage 42. Since vanes at positions 147, 148 and 149 are not contacting cam surface 31 but instead are located near the bottom of the slots, the outlet ports 40, 42, in the upper pressure plate are connected within the rotor to inlet ports 44, 46 where pressure is substantially atmospheric pressure. Curve 156 is inclined because of the pressure drop that occurs across the axial length of the vane as fluid is pumped through the terminal hole.

Pressure forces pumped by the falling vanes in the direction of rotation to the vanes within the rise quadrant of the cam tend to force those vanes radially outward. Curve 156 represents the variation of pressure in the terminal hole below the vanes as they begin to move from the terminal holes radially outward toward surface 31. A vane in the intermediate position 160, between a position at the bottom of the rotor slot and a position in contact with surface 31, is indicated in FIG. 8. Curve 158 shows a pressure drop along the length of the terminal hole from relatively high pressure within a terminal hole near the upper pressure plate and declining rapidly to a position between the pressure plates where pressure in the terminal hole passes through zero pressure and declines to a region of negative pressure as axial distance toward the upper plate increases. Negative pressure within the terminal hole causes fluid to flow from the interconnected inlet port 44, 46 and outlet ports 40, 42 through passages 140, 142 to the terminal hole 154. The volume of fluid flowing into each terminal hole is sufficient to refill the hole and is equal to the volume caused by the radially outward displacement of the vane.

This process is repeated when the vane passes again to the succeeding rise portion of the rotor between vane positions 152 and 153. Pressure continually increases within the terminal hole because fluid is pumped forward in the direction of rotation from the vane within the fall position, such as the vanes in positions 150, towards the vanes in the rise portion of the rotor at positions 152, 153 until vanes in the rise quadrant move radially outward into contact with the cam. Each time vanes that are not yet in contact with the cam move outward a portion of the distance toward the cam, volume displaced within the terminal hole is replaced with an equal volume of fluid flowing into the terminal hole below such a vane as previously described. This process continues with two such cycles in each rotor revolution until all of the vanes that have fallen to the bottom of their slots while the rotor was stopped have been driven outward into contact with surface 31 of the cam.

Referring to FIGS. 10–13, the orifice fitting 84 includes a cylinder 162 directed parallel to the axis of valve cylinder 14 having an aperture 114, a circular hole extending axially between ends 166, 168 of the cylinder. A circular flange 170, located at end 168 has a surface sized to engage the valve cylinder 14 with an interference fit, by which the orifice fitting is held in position. Tang 172, directed toward fitting 88, prevents contact of the valve with end 168, and closure of the aperture if fitting 84 moves along the valve cylinder.

Figure 14:
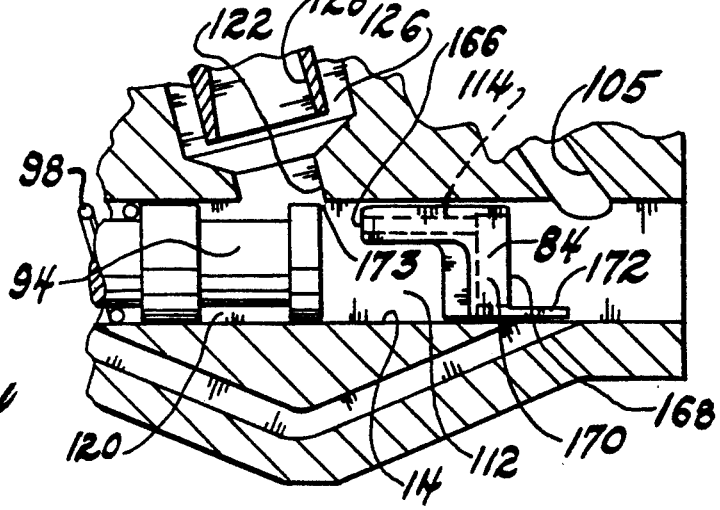
FIG. 14 is a partial cross section through the flow control valve and bypass diffuser showing a zone of pressure gradient near the orifice aperture and bypass port.

When bypass port 122 begins to open by moving to the position of FIG. 14, a steep pressure gradient occupies the local region adjacent bypass port opening 173. Pressure within that region varies from the high pressure generally present in the valve cylinder 14 between pump outlet port 112 and the end 166 of aperture 114 and the low pressure at the bypass port.

As the valve spool moves axially to open further the bypass port, the pressure gradient, from high pressure in the valve cylinder generally to low pressure near the bypass port, broadens in range across the end of the aperture such that pressure at the aperture end face 166 is lower than when the bypass port is closed or opened only slightly. When this occurs, pressure at the end of the aperture is lower than pressure elsewhere in the valve cylinder near the pump outlet 112. Pressure at the opposite end 168 of the aperture is lower than when the bypass valve is closed or opened less far. Consequently, when the bypass is opened sufficiently so that pressure at end 166 is lower than at the pump outlet, pressure falls in feedback line 115 leading from the downstream end 168 of the aperture to the end of the valve spool contacted by spring 98. This reduces the force on the spool tending to close the bypass valve, thereby further opening the bypass port.

Figure 15:
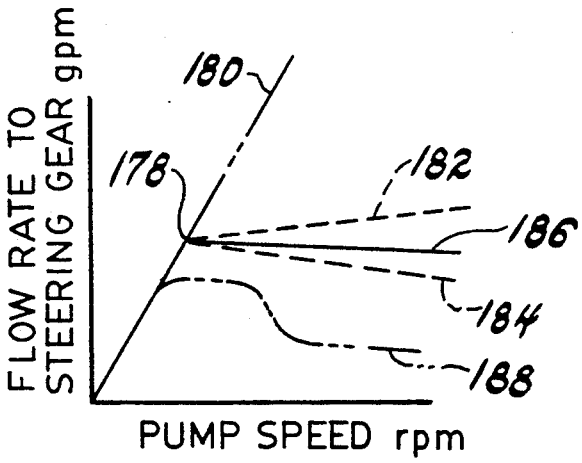
FIG. 15 is a graph showing the relation between fluid flow rate to a load and pump speed for a flow rate orifice located at various positions relative to a bypass port.

FIG. 15 shows graphically the effect of the location of the orifice aperture. The radial location of the aperture near the bypass port is located within the pressure gradient zone such that flow rate to the steering gear is abruptly changed at 178 in relation to pump speed after the bypass port opens. When that port is closed, flow rate to the steering gear changes proportionally with pump speed, as shown at 180 in FIG. 15. After pump speed rises to a predetermined critical speed 178, the linear relation to flow rate present at lower speeds, changes to a much lower positive slope 182, or a shallow negative slope 184 or a constant flow rate 186 at all speeds above the critical speed 178.

The position of the aperture at end 166 in relation to the bypass port and to the pressure gradient near the bypass port is determined so that the desired relation between flow rate to the steering gear and pump speed above the critical speed results. For example, when the distance of the aperture from bypass port is small, flow rate above the critical speed tends toward constant or slightly negative slope. When the aperture is located further from the bypass port, flow rate tends toward slightly positive inclination.

The effect of a drooper pin is represented in FIG. 15 by line 188.

Figure 16:
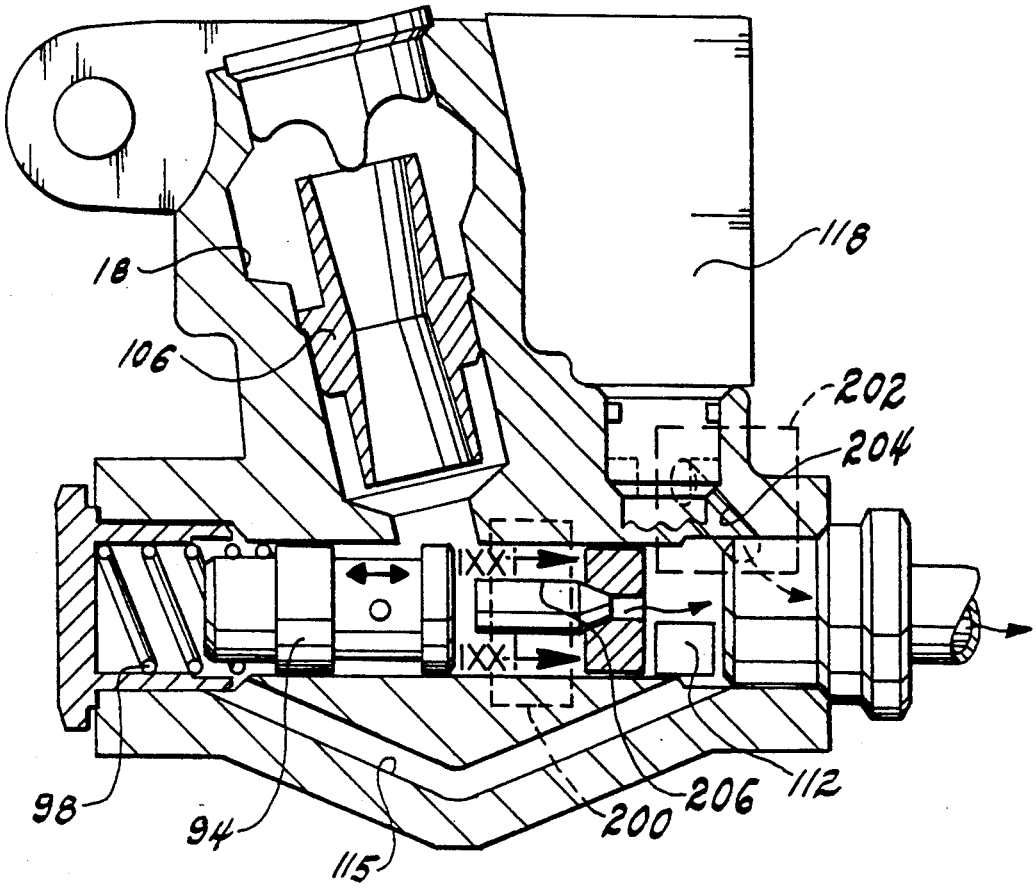
FIG. 16 is a schematic diagram of a flow rate control valve for an automotive source steering system showing suitable locations where increased wetted surface area can be located to enhance pump operation at high viscosity.

Cold starting is further enhanced in a flow control system of the type shown in FIGS. 2 and 4 by increasing the effective surface area along which fluid passes while flowing between pump outlet port 112 and passage 116 leading to the steering gear. FIG. 16 shows a first location 200 and second location 202 where the surface area can be increased to produce this effect.

In certain flow control systems, there is no electronically variable orifice but only orifice 114 connecting port 112 and passage 116. Other flow control systems have only an electronically variable orifice ("EVO") 105 and a passage 204 connecting the EVO to passage 116. When both an EVO and constant orifice are included in the control system, the EVO carries most of the fluid from the pump outlet to the steering gear and the fixed orifice is relatively small so that it carries a relatively small portion of the total flow from the pump.

Figure 17:
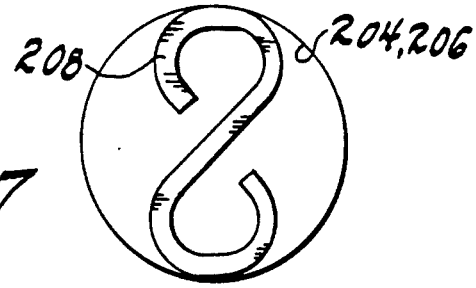
FIGS. 17, 18 and 19 show suitable devices for enhancing high viscosity operation of the system.
Figure 19:
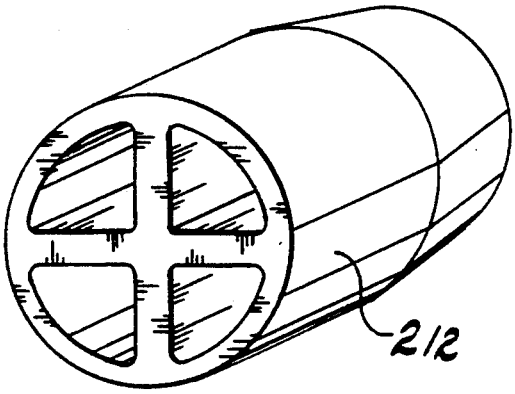
Figure 18:
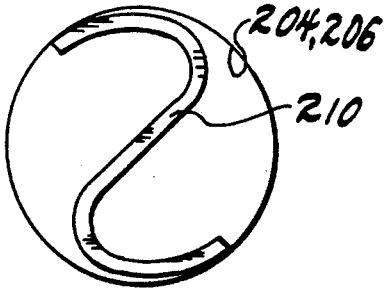

The pressure drop across passage 204 or 206 is increased above the pressure drop of the passage alone by inserting a device, such as one of those 208, 210, 212 shown in FIGS. 17–19, in either passage 204 or 206, which connect pump outlet port 112 and the pressure feedback line 115. These and other suitable devices have a large surface area, particularly a large wetted surface area and a relatively small cross sectional area. The device may be in the form of a wire or sheet metal clip, approximately 0.3 inches long, having in cross section several loops or arcs disposed in the passage and having outer surfaces adapted for interference fit with the surface of the passage, by which interference the clip is held in position against the effect of fluid flowing in the passage. Instead, the clip may be retained in a recess formed in the passage. The loops increase the surface area wetted by the fluid in the passage 204, 206 without appreciably increasing its cross sectional area.

An alternate technique involves having multiple small passages located between the pump outlet and the pressure feedback line 115 instead of one larger passage. The wetted surface area of the small passages is substantially greater than that of the larger passage yet the pressure drop across the smaller passages can be kept the same as that of the larger passage.

Another option is to increase the length of the passage 204, 206 that connects the orifice and the feedback pressure line. This effectively increases the wetted surface area of the passage without changing its cross sectional area.

These devices and techniques cause a larger pressure drop between the outlet of the pump and the feedback pressure line at low temperature, or while fluid viscosity is high, than they do at higher temperature because high viscosity causes the pressure drop to increase substantially due to large surface area drag. At relatively low viscosity, the effect of surface area is substantially less than when viscosity is high. The net cross sectional area of the passage 204, 206 and a restriction device such as a clip 208, 210, 212 located in the passage increases the pressure drop along the passage at both high viscosity and low viscosity. Therefore, the flow restriction device, or the form of the passage, is such that the increased wetted surface area is large compared to the reduction in cross sectional area.

The effect of the passage restrictions of this invention is to reduce, for a given pump discharge flow rate, the magnitude of the feedback pressure force developed on the valve spool 94, or to increase the pressure drop between the pump and the valve spool. Therefore, the valve opens the bypass port 122 more fully at low temperature than it does at higher temperature, thereby reducing the pressure drop in the tube connecting the remote reservoir and the pump inlet. Furthermore, at low temperature, the supercharging effect of the bypass diffuser 106, in drawing fluid from the reservoir and increasing pressures at the pump inlet, is enhanced.

Having described a preferred embodiment of my invention, what I claim and desire to secure by U.S. Letters Patent is:

1. An apparatus for enhancing the low temperature start-up of a power steering pump having an inlet and a discharge and being hydraulically connected to a power steering gear, said apparatus comprising:

valve means for controlling fluid flow to said power steering gear, said valve means having a pressure feedback bypass;

a fluid passage connecting said pump discharge and said steering gear; and flow restriction means disposed in said fluid passage for increasing flow resistance of fluid in said fluid passage at low temperature, said restriction means having a large surface area in comparison to the area of its cross section through a plane substantially transverse to the direction of the mainstream of fluid flow in the fluid passage, said flow restriction means comprising a restrictor operative to increase the fluid pressure differential between said pump inlet and said pressure feedback bypass so as to decrease feedback pressure force acting on said valve means, and whereby said restrictor causes an increased flow resistance of said fluid when said fluid is at a temperature below operating temperature resulting in a lower feedback pressure acting on said valve means so that an increased amount of fluid enters said pump inlet.

2. An apparatus according to claim 1, wherein said restrictor has a length extending along the passage, a thickness that is small in relation to its length, and a width, said restrictor having a cross sectional area disposed substantially normal to the direction of the mainstream of fluid flow in the passage substantially equal to the product of the width times the thickness, and a surface area substantially equal to twice the product of the width times the length.

3. An apparatus according to claim 1, wherein said restrictor has a length extending along the passage, a thickness that is small in relation to its length, and a width, said restrictor having a cross sectional area disposed substantially normal to the direction of the mainstream of fluid flow in the passage substantially equal to the product of the width times the thickness, and a surface area substantially equal to the product of the perimeter wetted by fluid in the passage times the length.

4. An apparatus according to claim 1, wherein said restrictor has a substantially S-shaped cross section and fits within the fluid passage with an interference fit, by which the restrictor is retained in position in the fluid passage.

5. An apparatus according to claim 1, wherein the fluid passage has a recess defining a shoulder against which the restrictor is held in contact and retained in position in the fluid passage.

6. An apparatus according to claim 22, wherein said flow restriction means comprises a generally cylindrical member defining a plurality of elongate passages therethrough.

7. In an automotive steering system having a constant displacement pump for controlling the flow rate of fluid from the discharge side of said pump to a steering gear, an apparatus for increasing flow resistance in the pump due to viscosity of the fluid, comprising:

valve means for controlling fluid flow to said steering gear, said valve means comprising a pressure feedback bypass and a spool valve having a first end and a second end in fluid communication with said bypass and operative to move from a first position to a second position in response to a pressure differential acting on said ends;

a fluid passage connecting the discharge side of said pump and said steering gear; and flow restriction means disposed in said fluid passage for increasing flow resistance of fluid in said fluid passage at low temperature and decreasing feedback pressure force acting against said second end of said spool valve through said bypass, said restriction means having a large surface area in comparison to the area of its cross section through a plane substantially transverse to the direction of the mainstream of fluid flow in the fluid passage, said flow restriction means comprising a restrictor operative to increase the fluid pressure differential between said pump inlet and said pressure feedback bypass so as to decrease feedback pressure force acting on said valve means, whereby said spool valve is held in said first position when said viscosity of said fluid is high resulting in an increase fluid flow to the pump inlet.

8. An apparatus according to claim 7, wherein said restrictor has a length extending along the passage, a thickness that is small in relation to its length, and a width, said restrictor having a cross sectional area disposed substantially normal to the direction of the mainstream of fluid flow in the passage substantially equal to the product of the width times the thickness, and a surface area substantially equal to twice the product of the width times the length.

9. An apparatus according to claim 7, wherein said restrictor has a length extending along the passage, a thickness that is small in relation to its length, and a width, said restrictor having a cross sectional area disposed substantially normal to the direction of the mainstream of fluid flow in the passage substantially equal to the product of the width times the thickness, and a surface area substantially equal to the product of the perimeter wetted by fluid in the passage times the length.

10. An apparatus according to claim 7, wherein said restrictor has a substantially S-shaped cross section and fits within the fluid passage with an interference fit, by which the restrictor is retained in position in the fluid passage.

11. An apparatus according to claim 7, wherein the fluid passage has a recess defining a shoulder against which the restrictor is held in contact and retained in position in the fluid passage.

12. An apparatus according to claim 7, wherein said flow restriction means comprises a generally cylindrical member defining a plurality of elongate passages therethrough.

13. A power steering pump for an automotive vehicle for providing fluid to a steering gear, comprising:

a valve cylinder having a spool valve slidable between a first and second position in response to a pressure differential acting thereon;

an outlet port through which fluid enters said valve cylinder, said outlet port communicating with the discharge side said pump;

a vent port communicating with the valve cylinder, opened and closed to said cylinder as said spool valve moves between said first and second positions;

orifice means hydraulically connecting the outlet port of said pump and said steering gear, having an inlet end thereof located in the valve cylinder and an outlet end thereof connected to the steering gear;

a pressure feedback passage means for applying pressure downstream of the orifice means to the spool;

a fluid passage hydraulically connecting the outlet port to the steering gear, having an inlet end connected to the outlet port and an outlet end connected to the steering gear or to the orifice means; and an S-shaped restrictor disposed in said fluid passage and operative to increase flow resistance of fluid in said fluid passage at low temperature and decrease feedback pressure force acting against said spool valve through said feedback passage, said restrictor having a large surface area in comparison to the area of its cross section through a plane substantially transverse to the direction of the mainstream of fluid flow in the fluid passage, whereby said spool valve is held in said first position when said viscosity of said fluid is high resulting in an increase fluid flow to the pump inlet.

* * * * *